US008042208B2

(12) United States Patent
Gilbert et al.

(10) Patent No.: US 8,042,208 B2
(45) Date of Patent: Oct. 25, 2011

(54) ROTATIONAL OPERATING TABLE

(76) Inventors: Jan Gilbert, Muncie, IN (US); Raymond E. Stidd, Bloomington, IN (US); Edward Houghton-Ward, Banora Point (AU); Jason McCrocklin, Anderson, IN (US); Jeremy John Ling, Saint Paul, MN (US)

( * ) Notice: Subject to any disclaimer, the term of this patent is extended or adjusted under 35 U.S.C. 154(b) by 354 days.

(21) Appl. No.: 11/620,549

(22) Filed: Jan. 5, 2007

(65) Prior Publication Data

US 2008/0222811 A1 Sep. 18, 2008

Related U.S. Application Data

(60) Provisional application No. 60/756,432, filed on Jan. 5, 2006, provisional application No. 60/774,940, filed on Feb. 17, 2006, provisional application No. 60/807,544, filed on Jul. 17, 2006.

(51) Int. Cl.
*A47B 7/00* (2006.01)

(52) U.S. Cl. ..... 5/607; 5/81.1 R; 5/660

(58) Field of Classification Search ..... 5/607, 81.1 R, 5/660, 509.1; 108/3, 7
See application file for complete search history.

(56) References Cited

U.S. PATENT DOCUMENTS

| | | | | | |
|---|---|---|---|---|---|
| 554,580 | A | | 2/1896 | Conkwright | |
| 2,223,405 | A | * | 12/1940 | Cain | 108/3 |
| 2,522,018 | A | | 9/1950 | Blackman | |
| 2,613,371 | A | | 10/1952 | Keyes | |
| 3,099,020 | A | | 7/1963 | Garfield | |
| 3,302,218 | A | | 2/1967 | Stryker | |
| 3,302,219 | A | | 2/1967 | Harris | |
| 3,609,357 | A | | 9/1971 | Jones | |
| 3,827,089 | A | | 8/1974 | Grow | |
| 3,875,598 | A | * | 4/1975 | Foster et al. | 5/607 |
| 3,924,281 | A | | 12/1975 | Gibbs | |
| 3,988,790 | A | | 11/1976 | Mracek | |
| 4,011,609 | A | | 3/1977 | Bethlen | |
| 4,084,274 | A | | 4/1978 | Willis | |
| 4,109,329 | A | | 8/1978 | Tupper | |
| 4,222,132 | A | | 9/1980 | Crim | |
| 4,244,358 | A | | 1/1981 | Pyers | |
| 4,274,168 | A | | 6/1981 | Depowski | |
| 4,356,577 | A | | 11/1982 | Taylor | |
| 4,357,722 | A | | 11/1982 | Thomson | |
| 4,658,451 | A | * | 4/1987 | Taniguchi | 5/607 |
| 4,776,047 | A | | 10/1988 | DiMatteo | |
| 4,873,732 | A | | 10/1989 | Perez | |
| 4,937,901 | A | | 7/1990 | Brennan | |
| 4,939,801 | A | | 7/1990 | Schaal | |
| 5,022,810 | A | | 6/1991 | Sherrow | |
| 5,088,706 | A | | 2/1992 | Jackson | |
| 5,101,519 | A | | 4/1992 | Yamamoto | |
| 5,103,511 | A | * | 4/1992 | Sequin | 5/607 |
| 5,131,106 | A | | 7/1992 | Jackson | |
| 5,224,228 | A | * | 7/1993 | Larrimore | 5/613 |
| 5,418,990 | A | | 5/1995 | Risasen | |

(Continued)

*Primary Examiner* — Michael Trettel
*Assistant Examiner* — William Kelleher
(74) *Attorney, Agent, or Firm* — Alan Lintel

(57) ABSTRACT

An operating table has first bed platforms, each which can rotate. In an operating configuration, the patient lies on one of the bed platforms in a prone or supine position with the bed platform centered over the base. When the patient needs to be turned, the other table extends outwardly, and both tables are rotated to position the patient for turning. Once the patient is turned, the table on which the patient lies is returned to its operating position over the base and the other table is returned to its storage position.

9 Claims, 12 Drawing Sheets

U.S. PATENT DOCUMENTS

| | | | | | |
|---|---|---|---|---|---|
| 5,479,665 | A | | 1/1996 | Cassidy | |
| 5,628,078 | A | | 5/1997 | Pennington | |
| 5,640,729 | A | * | 6/1997 | Marino | 5/607 |
| 5,659,905 | A | * | 8/1997 | Palmer et al. | 5/88.1 |
| 5,826,286 | A | | 10/1998 | Cranston | |
| 5,996,144 | A | | 12/1999 | Hodgetts | |
| 6,038,717 | A | * | 3/2000 | Persson | 5/607 |
| 6,112,349 | A | | 9/2000 | Connolly | |
| 6,131,215 | A | | 10/2000 | Lindell | |
| 6,230,342 | B1 | * | 5/2001 | Haugs | 5/607 |
| 6,282,736 | B1 | | 9/2001 | Hand | |
| 6,282,737 | B1 | | 9/2001 | Vrzalik | |
| 6,427,263 | B1 | | 8/2002 | Lindell | |
| 6,526,610 | B1 | | 3/2003 | Hand | |
| 6,668,396 | B2 | * | 12/2003 | Wei | 5/81.1 R |
| 6,701,553 | B1 | | 3/2004 | Hand | |
| 6,862,761 | B2 | | 3/2005 | Hand | |
| 6,874,182 | B2 | | 4/2005 | L'Hegarat | |
| 6,966,081 | B1 | | 11/2005 | Sharps | |
| 2006/0016007 | A1 | | 1/2006 | Hornbach | |

* cited by examiner

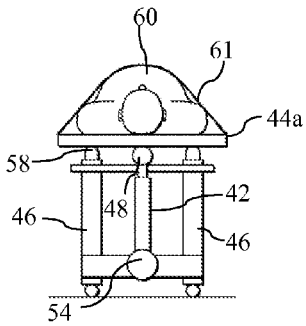

STEP 1

PATIENT PLACED ON TABLE.
PATIENT WEIGHED.
PATIENT STRAPPED IN POSITION.

*Fig. 4a*

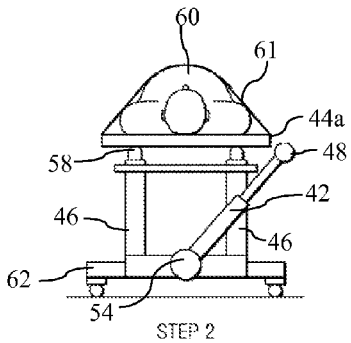

STEP 2

LEVER-ARM SWINGS T.L.T. WHEEL
TO EXTREMITY OF TABLE.
- RIGHT TRAVERSE.

*Fig. 4b*

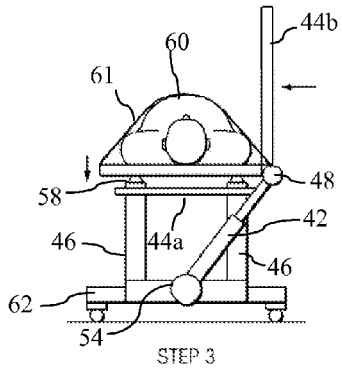

STEP 3

TABLE A JACKS LOWER 50 mm.
T.L.T. WHEEL SPIGOTS ENGAGE.
TABLE B ENGAGED WITH T.L.T.WHEEL
AND SPIGOTS LOCKED.

*Fig. 4c*

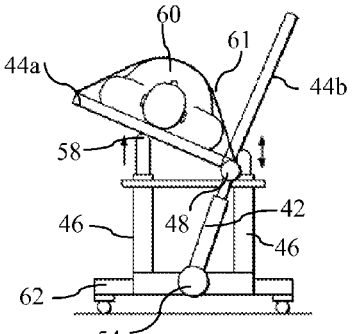

STEP 4

LEVER ARM TRAVERSES LEFT
JACK WITHIN LEVER ARM
RETAINS T.L.T. WHEEL.

JACKS 1-8 ADJUST TO WITHSTAND
VERTICAL LOADS.

*Fig. 4d*

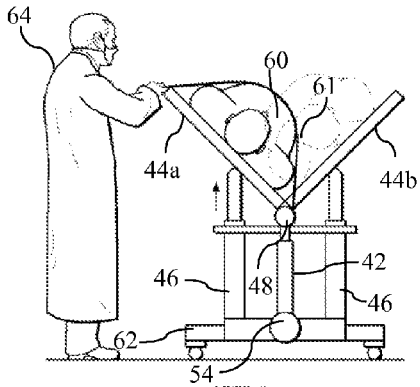

STEP 5

AT MIDPOINT MOTION CEASES.
SURGEON HAS FINGER-TIP
CONTROL OF RELEASE
OF PATIENT STRAPS
AND PATIENT IS TURNED.

*Fig. 4e*

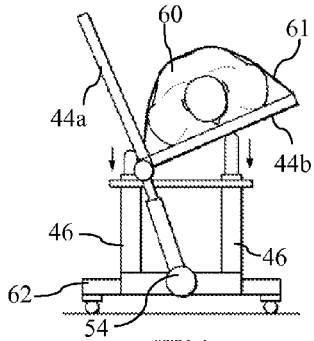

STEP 6

LEFT TRANSVERSE CONTINUES.
JACKS EXPAND AND CONTRACT
AS NECESSARY.
ALL MOTION CONTROLLED
BY COMPUTER.

*Fig. 4f*

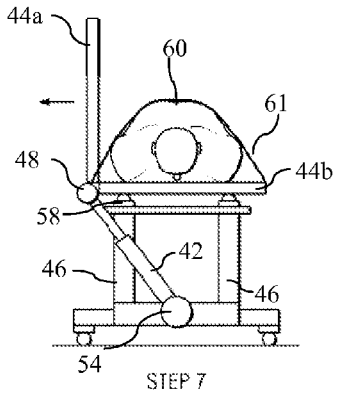
MOTION AND TURN COMPLETE, TABLE A REMOVED.
*Fig. 4g*
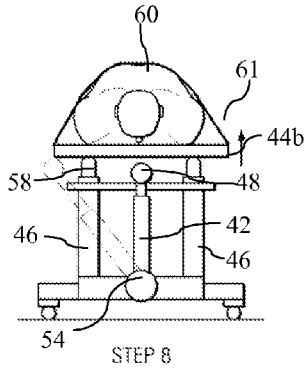
JACKS RAISE TABLE 50 mm TO ENABLE CENTRALIZATION OF T.L.T. WHEEL.
*Fig. 4h*
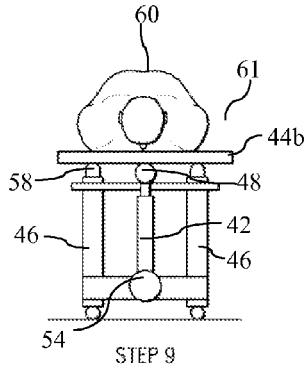
PATIENT STRAPS REMOVED, TABLE HEIGHT ADJUSTED TO SURGEON'S REQUIREMENTS.
*Fig. 4i*
*Fig. 5a*
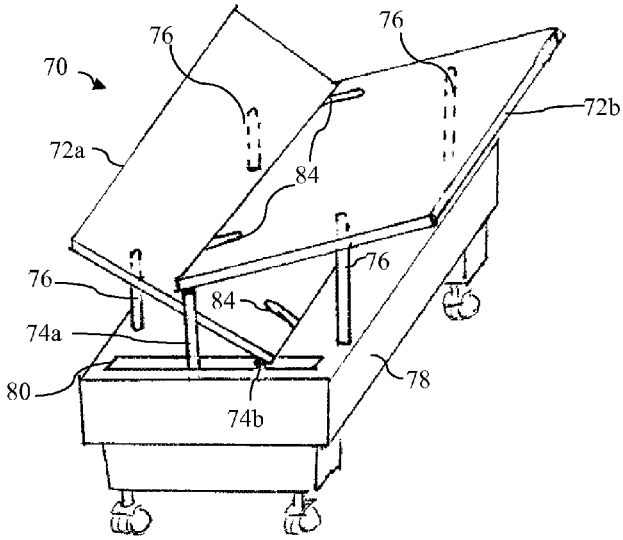

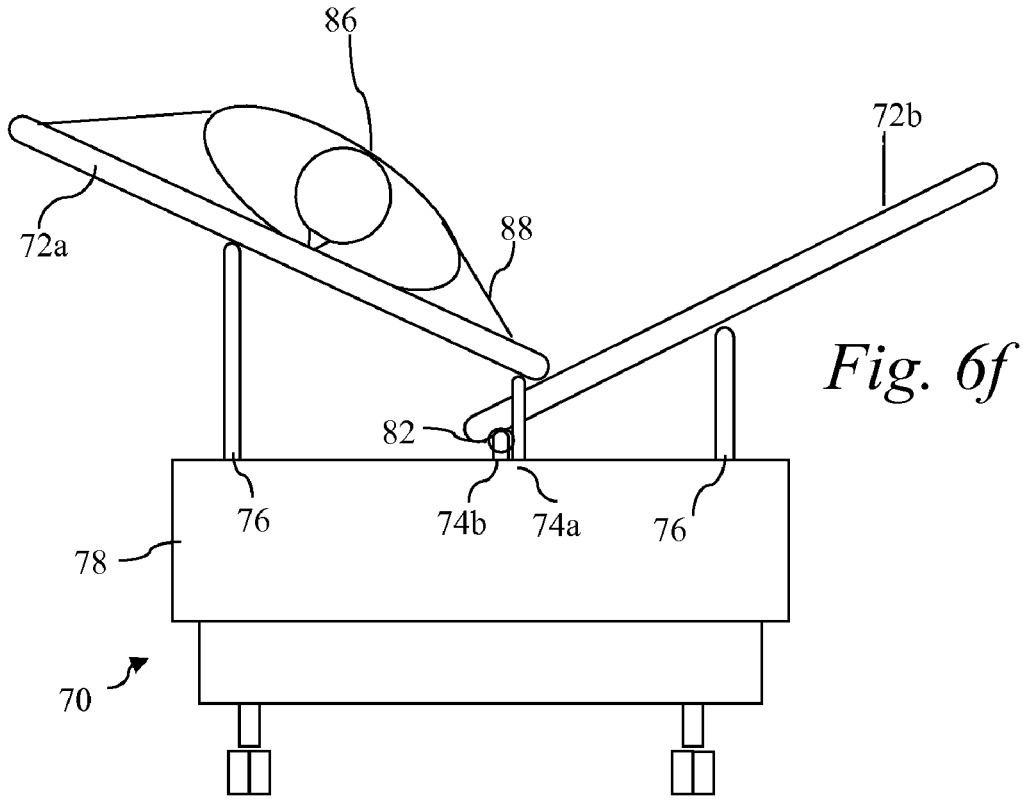
Fig. 6f
Fig. 6g
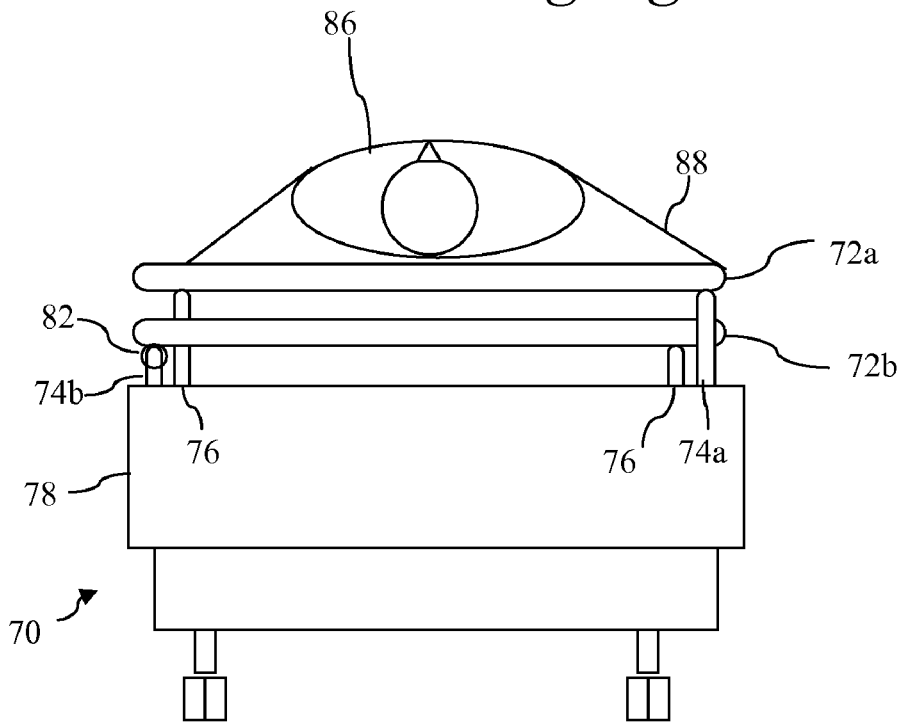

ROTATIONAL OPERATING TABLE

CROSS-REFERENCE TO RELATED APPLICATIONS

This application claims the benefit of the filing date of copending provisional applications U.S. Ser. No. 60/756,432, filed Jan. 5, 2006, entitled "ROTATIONAL OPERATING TABLE", U.S. Ser. No. 60/774,940, filed Feb. 17, 2006, entitled "ROTATIONAL OPERATING TABLE" and U.S. Ser. No. 60/807,544, filed Jul. 17, 2006, entitled "ROTATIONAL OPERATING TABLE", which are incorporated by reference herein.

STATEMENT OF FEDERALLY SPONSORED RESEARCH OR DEVELOPMENT

Not Applicable

BACKGROUND OF THE INVENTION

1. Technical Field

This invention relates in general to hospital equipment and, more particularly, to an operating table.

2. Description of the Related Art

Throughout a surgical procedure, there may be a need to switch a patient between supine and prone positions (and vice versa) on an operating table. The rotation of the patient wastes a considerable amount of time on behalf of the surgeon and his team, as well as medical facility staff who are involved in assembling and utilizing the in-house turn team needed to transfer the position of any given patient from the initial supine position to the desired prone position. At the end of the surgical procedure, the patient must be returned to the supine position for transport from the surgical area to the recovery area.

With existing equipment, there is recurring impending risk of injury to various members of the turn team and to the patient, especially obese patients—an issue which is increasing annually in the United States and in most developed countries. Standard operating bed platforms are too narrow to accommodate obese patients, and many bed platforms are not manufactured with a sturdy base that remains stable enough to hold very obese patients during the "turning process".

The number of personnel needed in the operating room to accomplish the patient rotation increases the constant threat of patient contamination and, further, potentially compromises the sterilization of onsite instrumentation. The invasive presence of multiple people breathing heavily and possibly coughing from straining while manipulating the patient creates a scenario for increased airborne microorganism contamination/infection.

Therefore, a need has arisen for an operating table that would decrease the number of individuals needed in the operating room while safely and effectively rotating a patient.

BRIEF SUMMARY OF THE INVENTION

In the present invention, an operating table comprises a first bed platform and a second bed platform. The first and second platforms are rotated to aid in positioning a patient from a first position on one of the platforms to a second position on the other of the platforms.

The present invention provides significant advantages over the prior art. The rotation of the first and second bed platforms allows a patient to be safely and quickly turned with a minimum amount of human effort, despite the weight of a patient.

The patient's weight may be maintained above the base of the table throughout the turning procedure, minimizing the chance that the table could overturn. The operating table can save significant money over time because of the considerable reduction in wasted time of operating room personnel, reduction of staff needed for turning patients, and lower liability insurance in the operating room. Further, the safety of the patient during the turn in considerably increased.

BRIEF DESCRIPTION OF THE SEVERAL VIEWS OF THE DRAWINGS

For a more complete understanding of the present invention, and the advantages thereof, reference is now made to the following descriptions taken in conjunction with the accompanying drawings, in which:

FIGS. 4*a* through 4*i* illustrate turning a patient using the table of FIG. 3;

FIGS. 5*a* through 5*b* illustrate a third embodiment of a rotational operating table;

FIGS. 6*a* through 6*g* illustrate turning a patient using the table of FIG. 5;

DETAILED DESCRIPTION OF THE INVENTION

The present invention is best understood in relation to FIGS. 1-7*a*-*e* of the drawings, like numerals being used for like elements of the various drawings.

Figure 1:
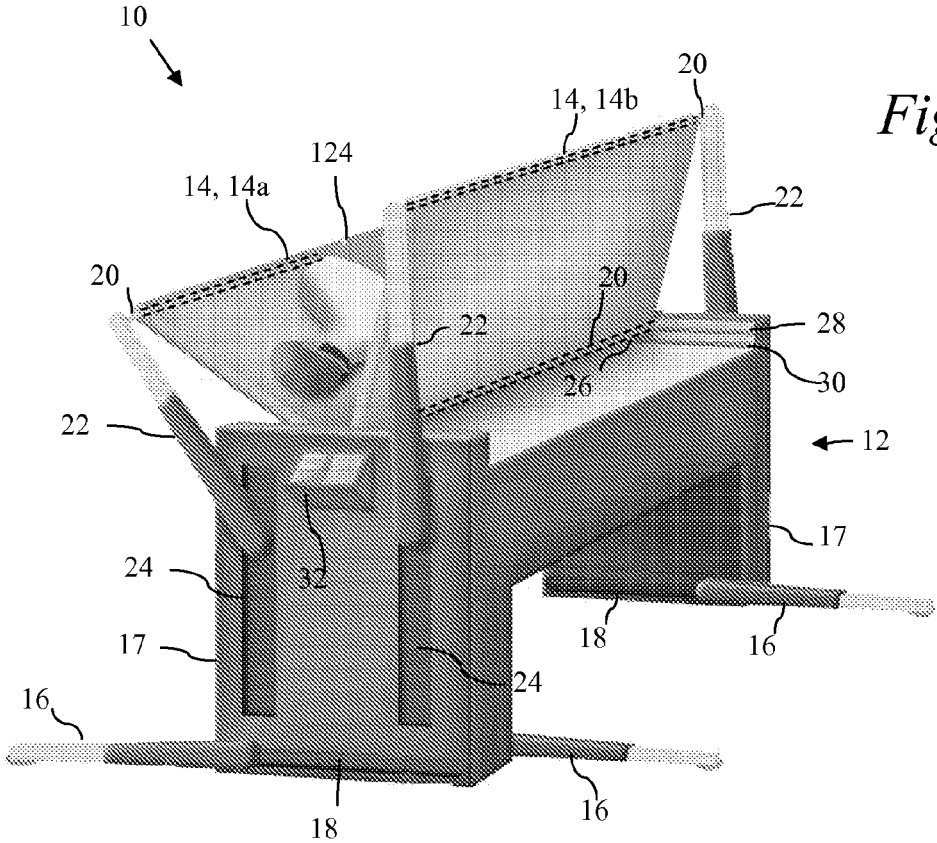
FIG. 1 illustrates a perspective view of a first embodiment of a rotational operating table.

FIG. 1 illustrates a first embodiment of an operating room table 10. A table base 12 provides a sturdy hollow housing for containing most of the moving parts and to support moving bed platforms 14 (individually referenced as 14*a* and 14*b*). The bed platforms (or "table tops") 14 are preferably radiolucent compatible, fabricated out of a strong lightweight material, such as graphite or similar non-metallic material. At the bottom of table 10, four mechanical telescoping legs 16 are capable of moving from a normal position to an extended position, in order to provide additional stability during a transfer. Each leg 16 is connected to a motor on the inside of the table end casing 17. The end of each leg 16 is coupled to a track 18. At the connecting point, each leg 16 can rotate to allow firm placement against the floor and to allow the extensions to move in and out.

Bed platforms 14 are pivotably attached to rods 20 (for example, 0.5 inch steel rods) positioned through the length of the outside and inside edges of each bed platform 14 at both edges of each bed platform 14. The rods 20 are fed through ball bearings (not shown) within the bed platforms 14 so that the rod can easily rotate within the bed platforms 14. The rods 20 at the outside edges of the bed platforms are coupled to a first end of telescoping and rotating arms 22 positioned at either end of the OR table 10. The second end of each arm 22 is coupled to a respective vertical track 24. The rods at the inside edges of the bed platforms 14 are coupled to wheels (not shown) which can be moved by track elevators 26 between upper horizontal tracks 28 and lower horizontal tracks 26 at the front and back of the table 10. The wheels travel horizontally along one of these tracks. A portable control panel 32 provides a display, such as a LCD screen, for table feedback and troubleshooting. Straps 34 hold the patient to a bed platform 14 during transfers.

In operation, the mechanical telescoping arms 22 can move to position the bed platforms 14 to desired positions and angles. The arms 22 are connected to motors located inside the table casing. The arms 22 can move up and down on vertical tracks 24 and can rotate about the connection point within a vertical plane. At the opposite side of the bed platforms 14, the track elevators allow the bed platform to move along either one of two horizontal tracks, upper horizontal track 28 or lower horizontal track 30. Both bed platforms could be in the same horizontal track, or in different horizontal tracks, depending upon the configuration. Having both bed platforms 14 in the same track provides for a flat bed platform configuration (a double width bed platform using both bed platforms 14*a* and 14*b*), while bed platforms 14 in different tracks allows the bed platforms 14 to be stacked on top of one anther. An angled configuration, as shown, can be provided with the bed platforms on the same horizontal track or in different horizontal tracks.

The track elevators 26 move the inside rods 20 of bed platforms 14 between tracks 28 and 30. The track elevators are located, for example, in the center of the tracks 28 and 30. When the arms 22 pull the bed platforms apart for rotation, the wheels (not shown) coupling the bed platforms to the tracks 28 and/or 30 move along the track to the center where the track elevators 26 are located. When a wheel moves into the elevator, it is secured, for example by a spring-loaded latch. Once in position, it can be raised or lowered to the complementary track 28 or 30.

Figure 2A:
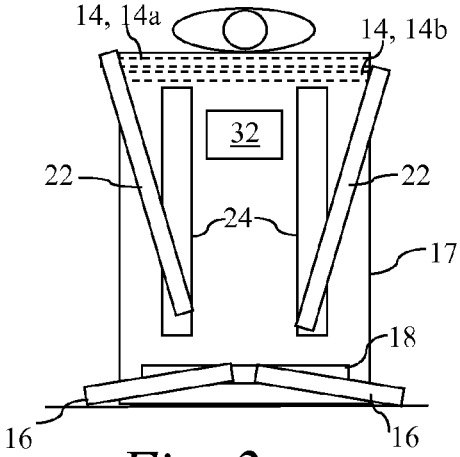
FIGS. 2*a* through 2*h* illustrate operation of the operating table of FIG. 1 to turn a patient from a supine position to a prone position (or vice versa)
Figure 2B:
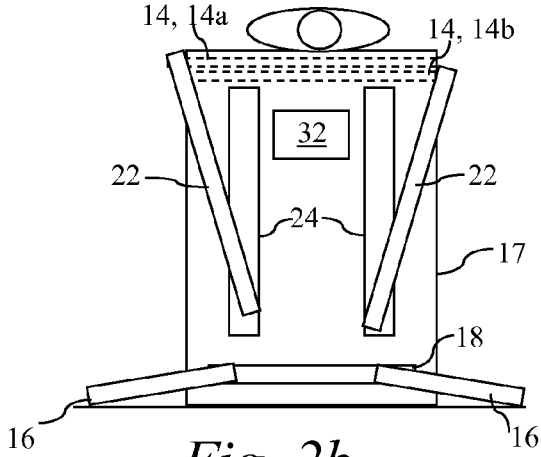
Figure 2C:
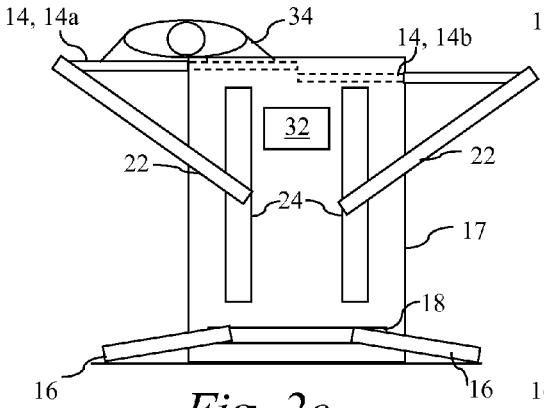

FIGS. 2*a*-2*g* illustrate the operation of table 10 to rotate a patient from a supine position to a prone position (or vice versa). In FIG. 2*a*, the bed platforms 14 are initially positioned atop one another with the patient on the top bed platform (bed platform 14*a* in the illustrated embodiment). In FIG. 2*b*, the stabilizing legs 16 are extended outwardly to provide support during the rotation of the patient between the bed platforms. In FIG. 2*c*, the arms 22 are activated via the control panel 32. The arms 22 pull each bed platform 14 outwardly along its respective track (28 or 30) such that the wheels on the inside are situated near the track elevators 26.

Figure 2D:
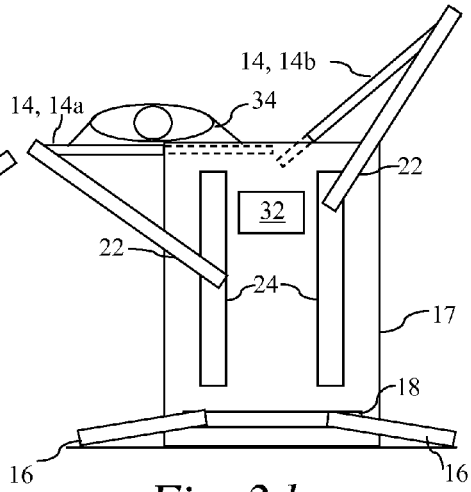
Figure 2E:
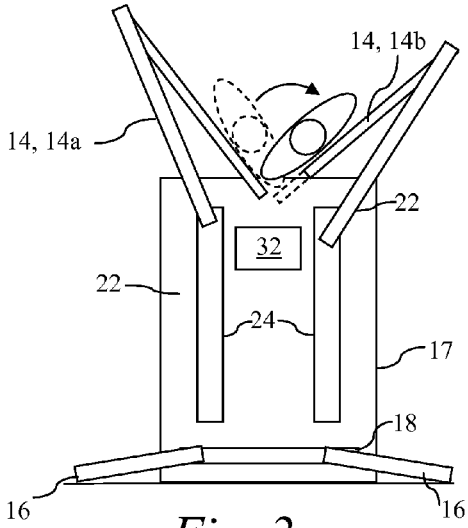

In FIG. 2*d*, bed platform 14*b* (previously situated below bed platform 14*a*) is lifted by the positioning arms 22 to a predetermined angle for receiving the patient. In FIG. 2*e*, the straps 34 are removed from the patient and bed platform 14*a* is lifted to about 80 degrees, rotating the patient onto bed platform 14*b*, in a prone position, using minimal surgical staff, since the weight of the patient does not need to be supported.

Figure 2F:
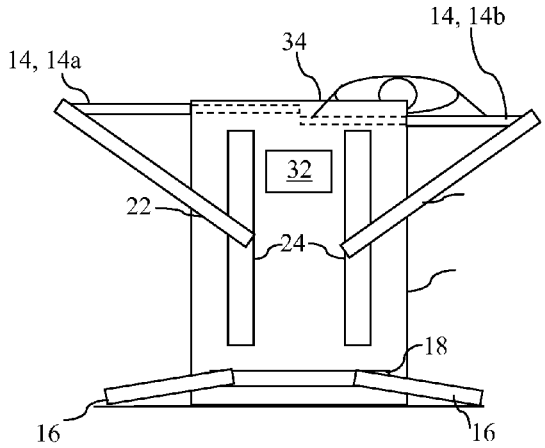
Figure 2G:
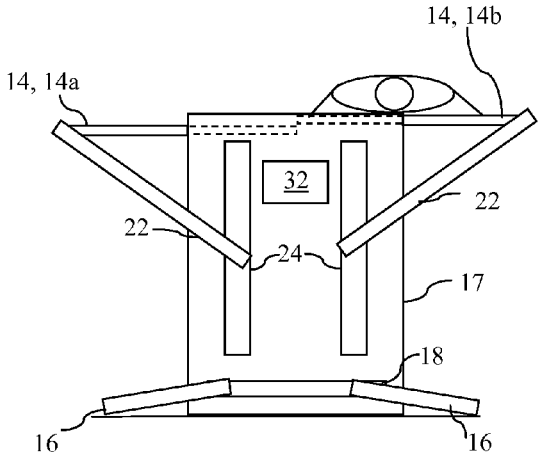
Figure 2H:
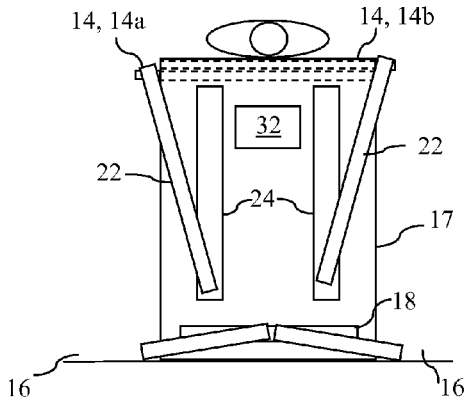

In FIG. 2*f*, the patient is secured with the straps 34 of bed platform 14*b*. Bed platform 14*b* is brought to a level position and bed platform 14*a* is the also brought to a level position. In FIG. 2*g*, wheels of each bed platform are secured within the track elevators 26 and moved to the opposite track—i.e., the wheels of bed platform 14*a* are lowered to lower tracks 30 and the wheels of bed platform 14*b* are raised to upper tracks 28. In FIG. 2*h*, the arms 22 push each bed platform 14 inwardly such that bed platform 14*a* is directly beneath bed platform 14*b*. The stabilizing arms 16 are retracted to their normal position.

The procedures set forth in FIGS. 2*a*-*h* can be reversed to rotate the patient back to the supine position.

Figure 3:
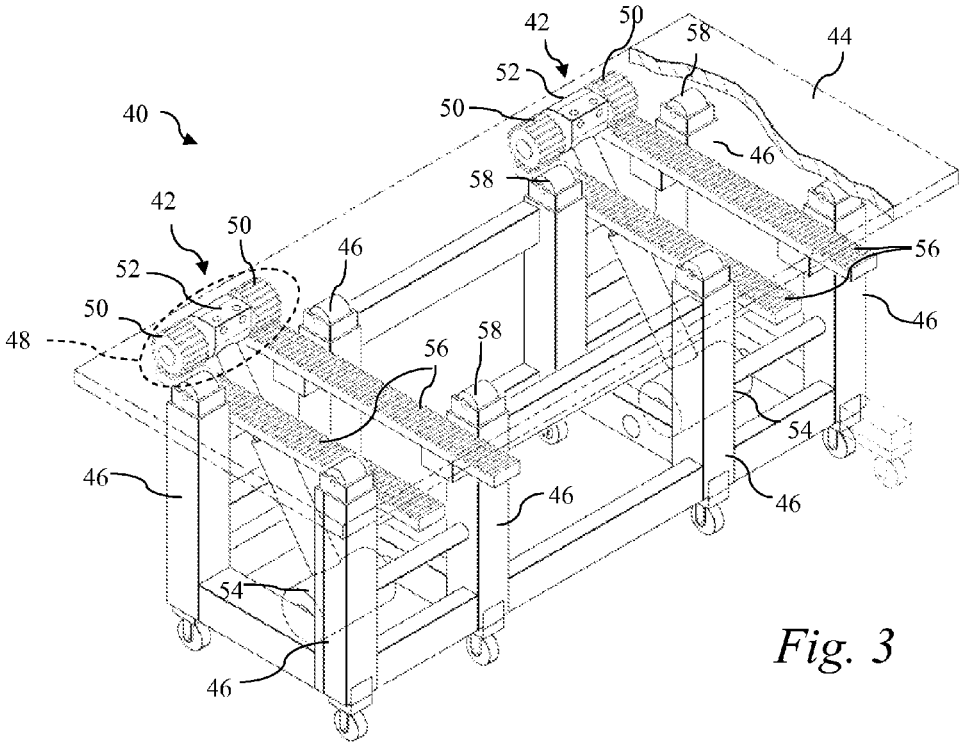
FIG. 3 illustrates a perspective view of a second embodiment of a rotational operating table.

A second embodiment of an operating table is shown in FIG. 3, with its operation described platform in FIGS. 4*a*-*i*. The operating table 40 uses two separate, but commonly controlled, mechanisms to flip the patient. The first mechanism includes two (or more) lever arms 42 which attach to the bed platforms 44 to provide movement of the bed platform(s) 44 in a horizontal plane. The second mechanism is the array of bed platform jacks 46. The bed platform jacks 46 provide vertical movement to the bed platforms 44 during the flipping and also provide vertical positioning of the patient under normal use of the operating table 40.

Each lever arm 42 includes a TLT (table-lock-turn) wheel 48 comprising two gears 50 and a carriage 52. The two gears 50 ride on respective tracks. The carriage 52 is located between the two gears 50 of each lever arm 42. The carriage 52 can freely rotate. A motor 54 at the bottom of the lever arm 42 provides rotational motion to the lever arm 42 to position the carriage 52 at any point along a respective track 56 engaging the gears. Each lever arm 42 automatically retracts to maintain contact with the tracks as the lever arm moves.

The jacks 46 have wheels 58 at their tops. The bed platforms 44 roll along the wheels 58 on the tops of the jacks 46 in response to movement of the lever arms 42. The bed platform jacks 46 are arranged in two rows, the height of the jacks of each row being separately controllable, such that the jacks 46 can apply a tilt to the bed platforms 44, as shown below.

The operation of the operating table 40 during a patient flipping procedure is shown in FIGS. 4*a*-*i*. In the first step shown in FIG. 4*a*, the patient 60 is placed on top of a first bed platform 44*a*. For proper control of the table during the flipping procedure, the weight of the patient 60 is taken and the patient 60 is strapped onto the first bed platform 44*a* using straps 61.

In the second step shown in FIG. 4*b*, the legs 62 at the bottom of the table are extended for greater stability. The lever arms 42 swing to the right side of the first bed platform 44*a* and the carriages 52 are connected to the first bed platform 44*a* using, for example, pins or "spigots". The spigots lock the first bed platform to the carriages 52.

In the third step shown in FIG. 4*c*, spigots are used to lock the second bed platform 44*b* to the carriages 52 such that the second bed platform 44*b* is at a 90 degree angle relative to the first bed platform 44*a*.

In the fourth step shown in FIG. 4*d*, the TLT wheels 48 are moved to an intermediate position on the tracks 56, just to the left of right-hand row of jacks 46. The gears 50 of each TLT wheel 58 engage with their respective track 56. The left-hand row of jacks 46 rises to impart an angle to the bed platforms. As the lever arm 42 continues to move the TLT wheel 48 to the left, the height of the left- and right-hand rows of jacks 46 are adjusted to increase the angle of the first bed platform 44*a* relative to the horizontal. The first bed platform 44*a* and second bed platform 44*b* are locked in a ninety degree relationship.

In the fifth step shown in FIG. 4*e*, the lever arms 42 are vertically oriented such that each TLT wheel 48 is in the mid-point of its respective track 56. At this point, the first bed platform 44*a* and second bed platform 44*b* are both at a 45 degree angle to the horizontal. The surgeon (or staff) 64 releases the strap 61 holding the patient to the first bed platform and rotates the patient 60 from the first bed platform 44*a* to the second bed platform 44*b*. The patient 60 is then strapped to the second bed platform 44*b*.

In the sixth step shown in FIG. 4*f*, the TLT wheels 48 continue to move to the left, as the height of the rows of jacks 46 are adjusted to reduce the angle of the second bed platform 44*b* relative to the horizontal.

In the seventh step shown in FIG. 4*g*, the second bed platform 44*b* is positioned in a horizontal plane and the first bed platform 44*a* is removed from the carriages 52 of the TLT wheel 48.

In the eighth step shown in FIG. 4*h*, the second bed platform 44*b* is also released from the carriages of the TLT wheels 48 and the jacks 46 raise the table to allow the lever arms 42 to re-position themselves below the bed platform.

In the ninth step shown in FIG. 4*i*, the straps 61 are removed from the patient 60 and the jacks 56 are adjusted to raise or lower the second bed platform 44*b* to a desirable position.

The steps shown in FIGS. 4*a-i* can be repeated as necessary to rotate the patient again.

Figure 5B:
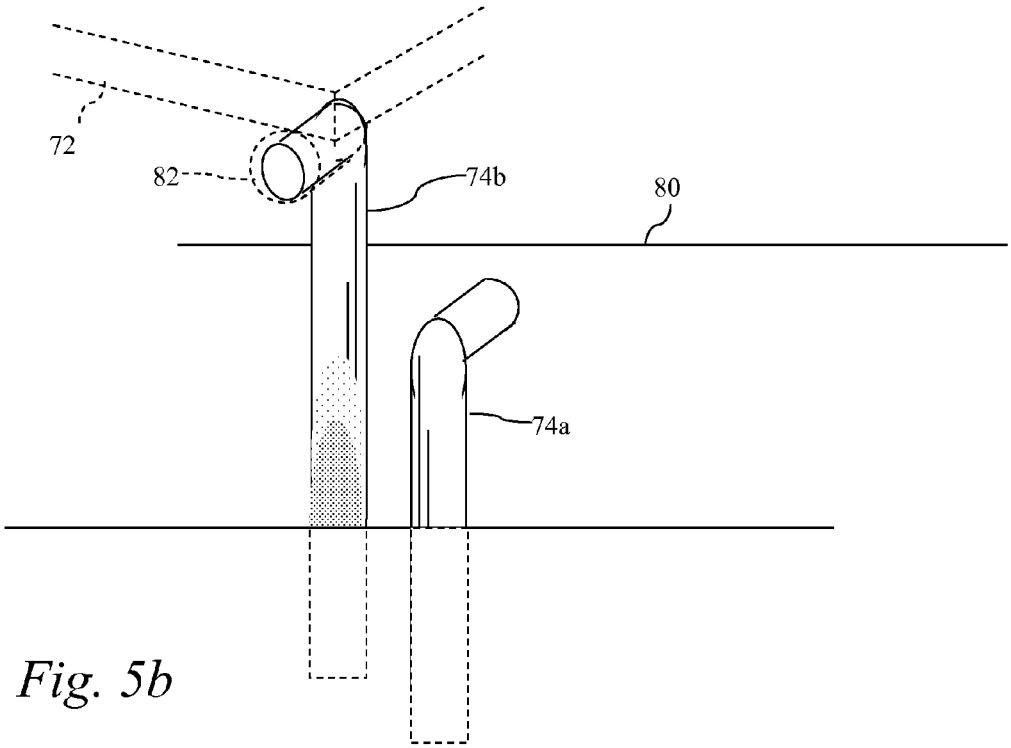

FIG. 5*a* illustrates a perspective view of a third embodiment of a rotation operating table 70. Operating table 70 has first and second bed platforms 72 (individually referenced as bed platforms 72*a* and 72*b*), which are rotated by arms 74 and jacks 76 disposed in housing 78. Two pairs of arms 74 (located at each end of the table housing 78 through opening 80) include an outside arm 74*a* (positioned closer to the front or back of the table 70) and an inside arm 74*b* (positioned closer to the center of the table 70). The arms 74 are shown in greater detail in FIG. 5*b*. The arms 74 move both vertically and laterally; the arms can pass one another without touching; hence each arm can traverse the opening 80 from end to end. Arms 74 couple with brackets 82 (see FIG. 5*b*) located near the corner of the beds 72. Each arm 74*a-b* can attach to either bed platform 72*a* or 72*b*.

Jacks 76 move vertically up and down and the bed platforms 72 slide on the tops of the jacks 76 (the top of the jack may include a rotating wheel or ball to facilitate sliding). Slots 84 are formed in the bed platforms 72 such that the jacks 76 do not impede the positioning of the bed platform (for example, as shown in FIG. 6*a*).

Figure 6A:
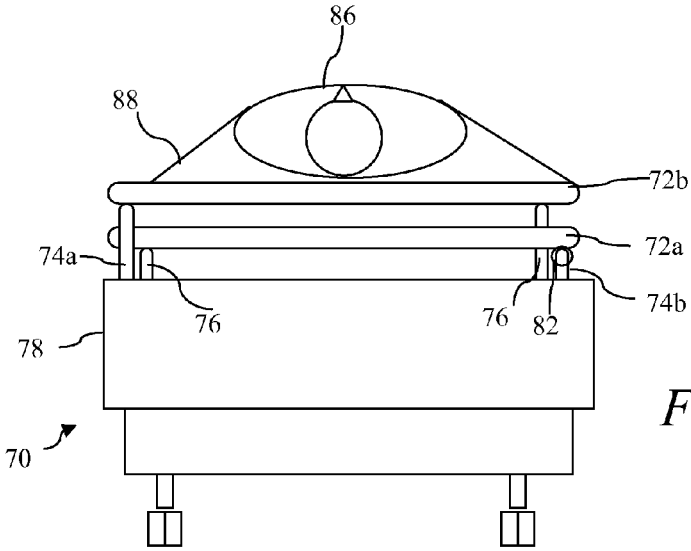

FIGS. 6*a* through 6*g* illustrate the operation of the operating table 70 of FIG. 5*a*. In FIG. 6*a*, the patient 86 is in a supine position and held to bed platform 72*b* using straps 88. As shown in connection with FIGS. 6*c* and 6*d*, the straps can be extended or retracted as the patient is on a bed platform 72. The extension and retraction of the straps could be performed using a motor and control circuitry or manually using tension controlled through a mechanical aid such as a cleat, pulley or similar device. The retractable/extendable straps could be used on other embodiments of the operating table shown herein as well.

Figure 6B:
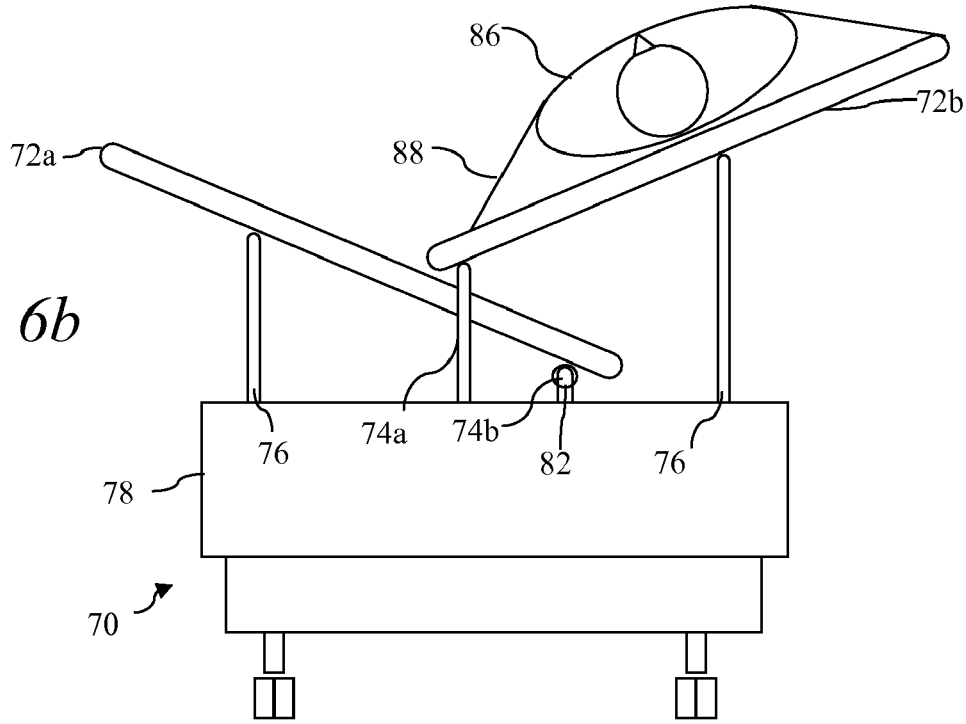

In FIG. 6*b*, the jacks 76 are extended upward as arms 74*a* and 74*b* traverse inward. Arm 74*a* moves upward and arm 74*b* moves downward to begin the rotation of bed platform 72*a* and 72*b* towards one another.

Figure 6C:
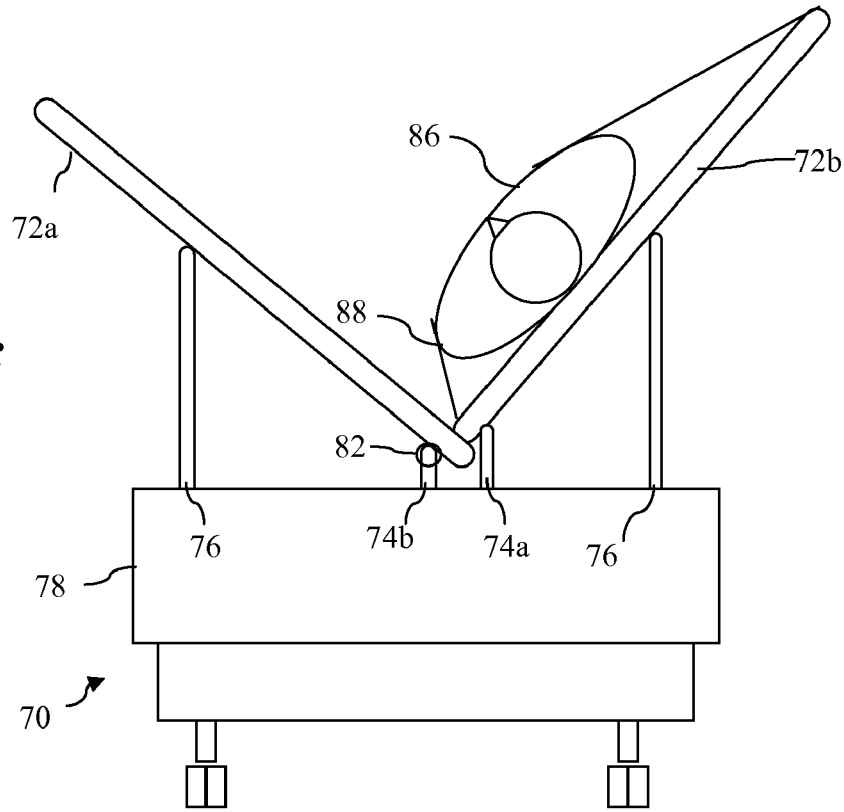
Figure 6D:
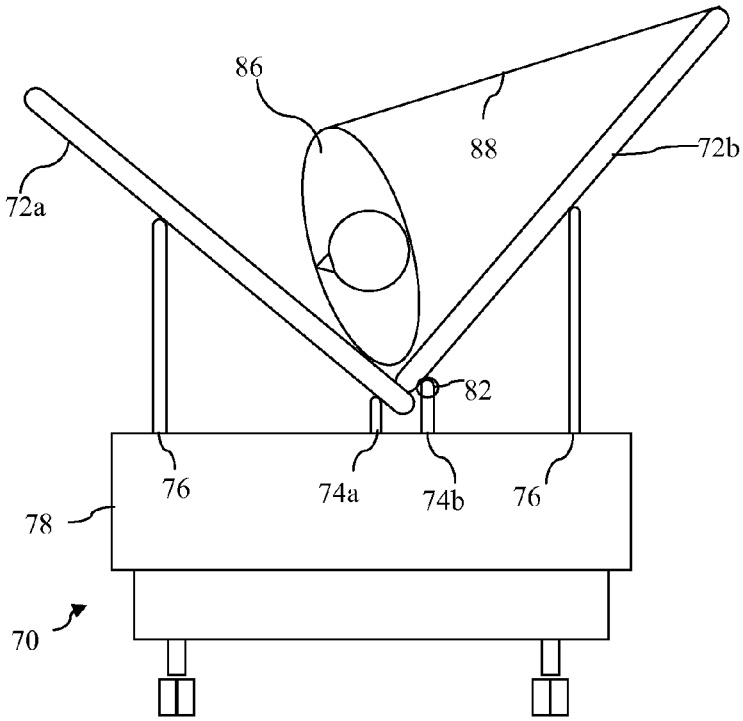

In FIG. 6*c*, the bed platform 72*a* and 72*b* are at approximately ninety degrees, with bed platform 72*b* resting on bed platform 72*a*, such that there is no gap between the bed platforms (or both bed platforms 72 could have an edge resting on a non-slip portion of the housing 78). In FIGS. 6*c* and 6*d*, two operations are happening: (1) the arms 74*a* and 74*b* are switching between bed platforms 72 (i.e., arm 74*a* is coupled to bed platform 72*a* in FIG. 6*c* and is coupled to bed platform 72*b* in FIG. 6*d*; likewise, arm 74*b* is coupled to bed platform 72*b* in FIG. 6*c* and is coupled to bed platform 72*a* in FIG. 6*d*) and (2) the straps 88 are being extended to allow the patient 86 to slowly drop into the corner between the two bed platforms and rotate to a prone position on bed platform 72*a*.

In an alternative embodiment, the arms 74*a* and 74*b* could be permanently attached to respective bed platforms 72*a* and 72*b*, with the arms capable of switching front and back positions with in the housing.

In order to maintain the stability of the bed platform 72 during the switching of the arms, on set of arms (i.e., the front set of arms 74*a* and 74*b*) are switched first and the other set of arms (i.e., the back set of arms 74*a* and 74*b*) are switched second. This may help prevent the bed platforms 72 from rotating during the switch.

Figure 6E:
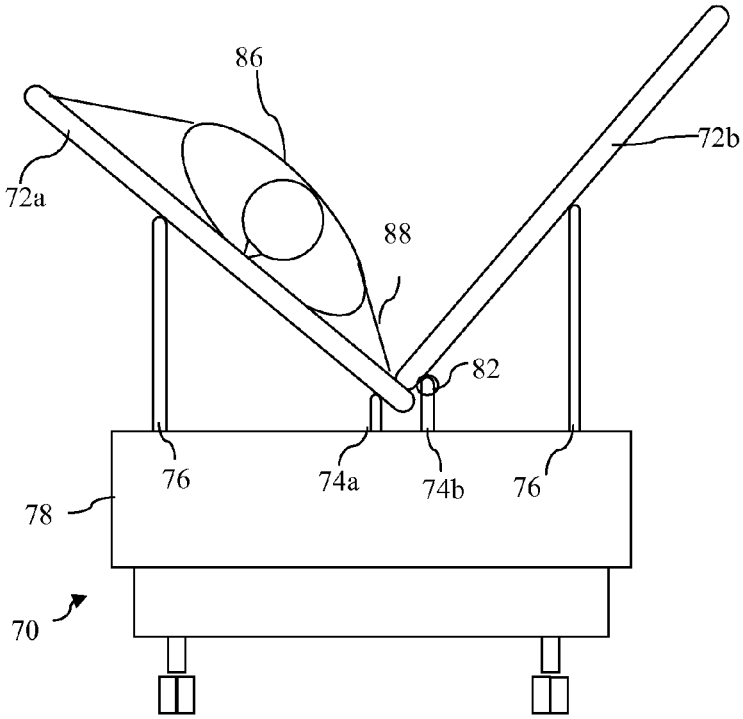

In FIG. 6*e*, once the patient 86 is positioned in a prone position on the bed platform 72*a*, the straps 88 of bed platform 72*b* are released and straps 88 of bed platform 72*a* are secured around the patient 86.

In FIGS. 6*f* and 6*g*, the tables are lowered by lowering the jacks and moving the arms outwardly. In FIG. 6*g*, the bed platforms 72 are oriented horizontally, with bed platform 72*a* above 72*b*.

The embodiments shown in FIGS. 1 through 6*g* allow a patient to be safely and quickly turned with a minimum amount of human effort, despite the weight of a patient. An important aspect of these embodiments is that the patient's weight is maintained above the base of the table throughout the turning procedure, minimizing the chance that the table could overturn. The extra expense of a high technology table is cost effective over time because of the considerable savings in reducing medical facility overhead, concurrent with probable lower liability insurance in the operating room.

It is estimated the average turn time for the normal patient by a typical turn team (4 to 6 staff members, depending on the patient's weight) from the moment of decision by the surgeon until the patient is successfully turned, redraped, and all instrumentation repositioned is optimally 23 minutes. Extremely obese patients may take considerably longer. It is estimated that utilizing the table shown and described platform herein will cut the time factor by at least 50 percent, to an average turn time of 12-15 minutes. This translates to a gain of at least 20 minutes with each surgical team per day—more if additional turns are needed during any given surgical procedure. Thus, the time saved will allow for at least one additional operating procedure to be scheduled and performed each day, resulting in enhanced efficiency and increased revenue for physicians, caregivers, and hospitals.

The invention is also important in reducing injuries to the turn team. The nurses, operating technicians, and ancillary personnel often suffer knee, hip, and back injuries from the tugging/lifting maneuvers necessary in the rotation of very obese patients. Worse than that are the injuries sustained by patients who are either dropped, partially dropped or compromised throughout the turning process because they are tethered to hoses, anesthesia devices, and monitors that must be maintained throughout the turning process.

A general consensus exists that these injuries to both staff and patient are not consistently recorded, documented or reported, and the incidence is, in reality, much higher than recorded by most medical facilities. The present invention reduces the risk of injury to staff and patient, and thus reduces the overall liability of the hospital.

A third embodiment is shown in FIGS. 7*a-e*. This embodiment does not maintain the patient's weight in the middle of the table throughout the entire turning process; however, it may be a cheaper alternative for use with patients with relatively low weights, such as children and small adults.

Figure 7A:
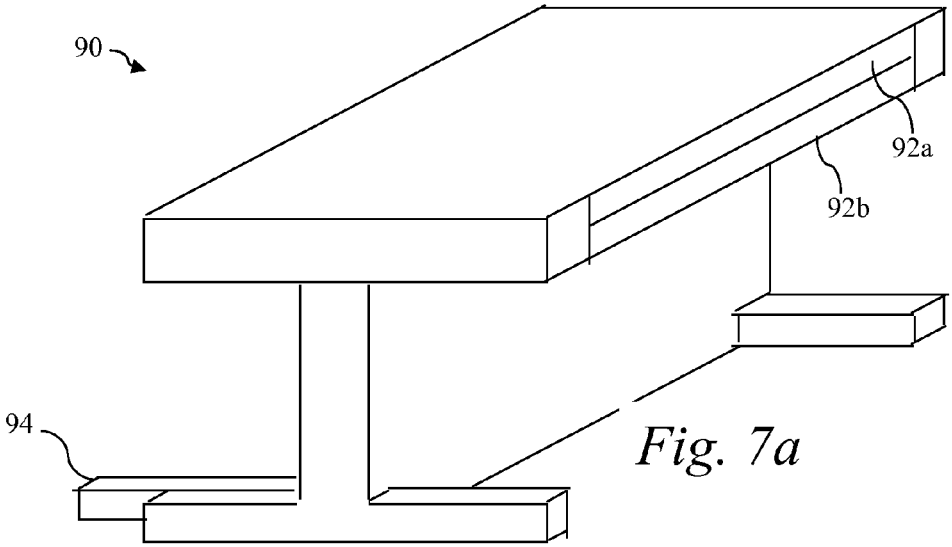
FIG. 7*a* illustrates a perspective view of a fourth embodiment of a rotational operating table.
Figure 7B:
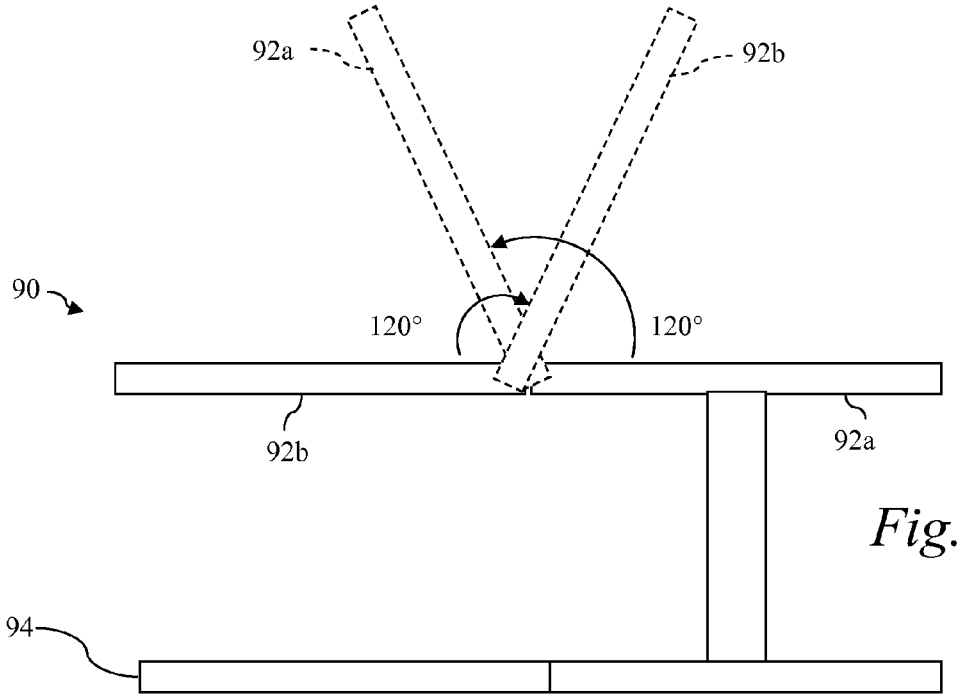
FIGS. 7*b* through 7*e* illustrate turning a patient using the table of FIG. 7*a*.

FIGS. 7*a-b* illustrates a table 90 with the two separately controllable bed platforms, a primary bed platform 92*a* and alternate bed platform 92*b*. Each bed platform can rotate approximately 120 degrees from a horizontal position. Stabilizing legs provide a stable supply support at the floor.

By activating a "replacement table lifting button" the bed platform of table will rise to an appropriate position. By activating a "lateral shift button", the patient is slowly moved to side of bed platform (on the primary bed platform 92*a*) and rests safely in the temporary position stage.

By activating a "secondary/replacement bed platform" button, the alternate bed platform 92*b* rises from its stored position in a lower portion of the table to an extended position (as shown in FIG. 7*b*), ready to accept the patient after rotation.

Figure 7C:
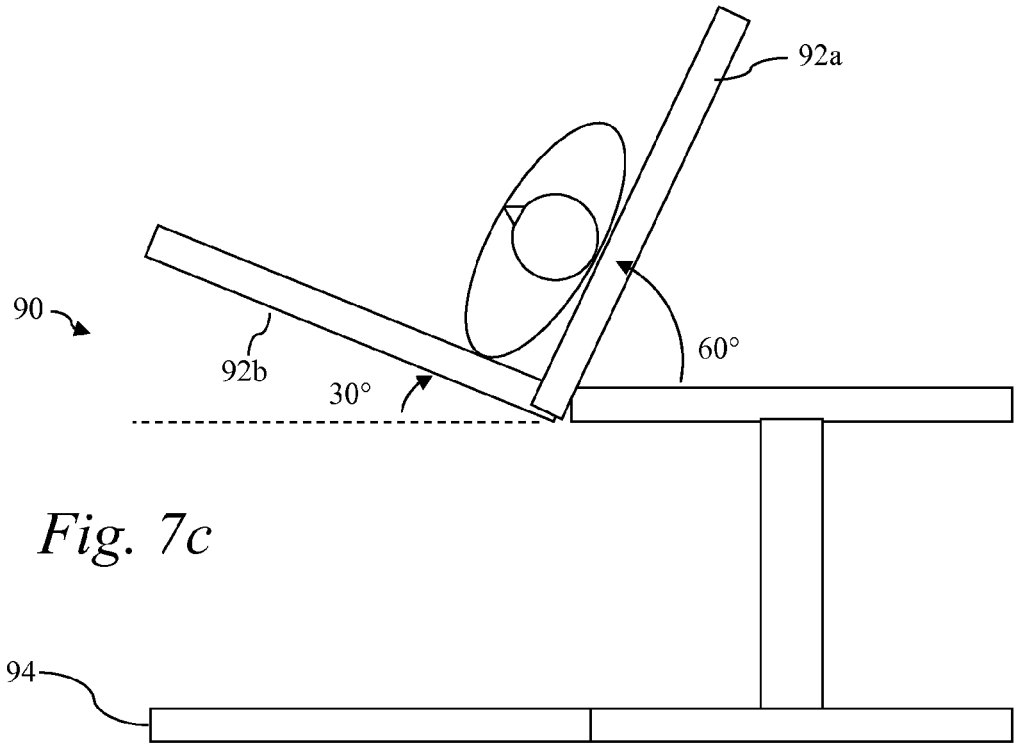

A "patient rotation button" is activated to permit the primary bed platform 92*a* to slowly lift and rotate the patient from supine to prone-roll position, as shown in FIG. 7*c*. The patient is rolled from a supine position on the primary bed platform (at an angle of about 60 degrees relative to the horizontal) to a prone position on the alternative bed platform (at an angle of about 30 degrees relative to the horizontal, creating an angle of about 90 degrees between the primary and alternative bed platforms). Because of the angle of the patient in a supine position at approximately 60 degrees, the table allows gravity to aid in rotating the patient to a prone position at 30 degrees, without danger of injury to the patient.

Figure 7D:
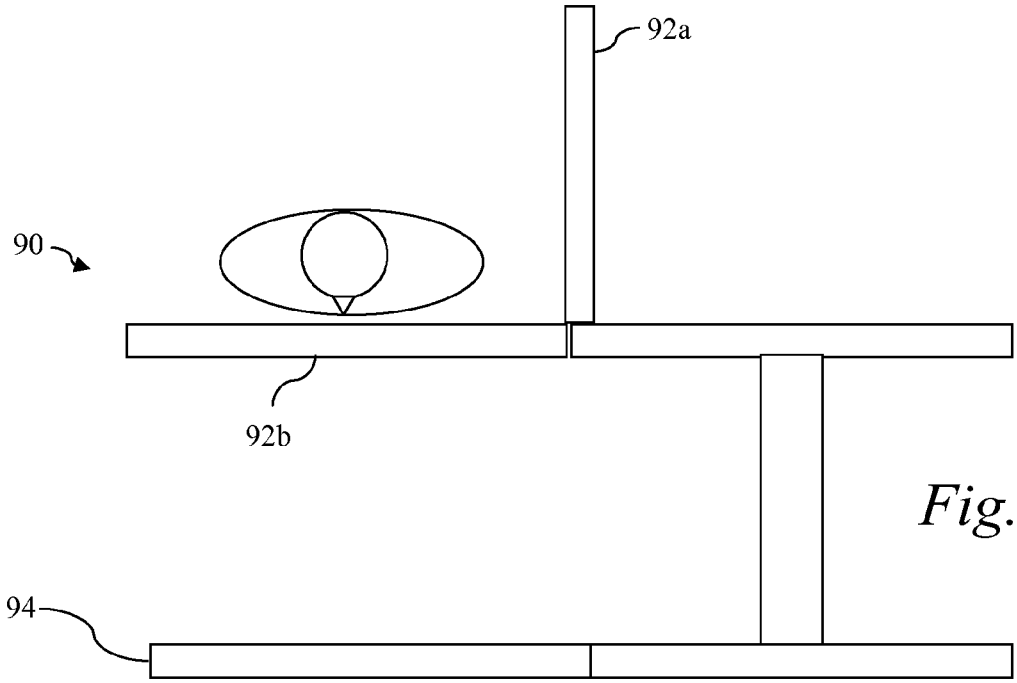
Figure 7E:
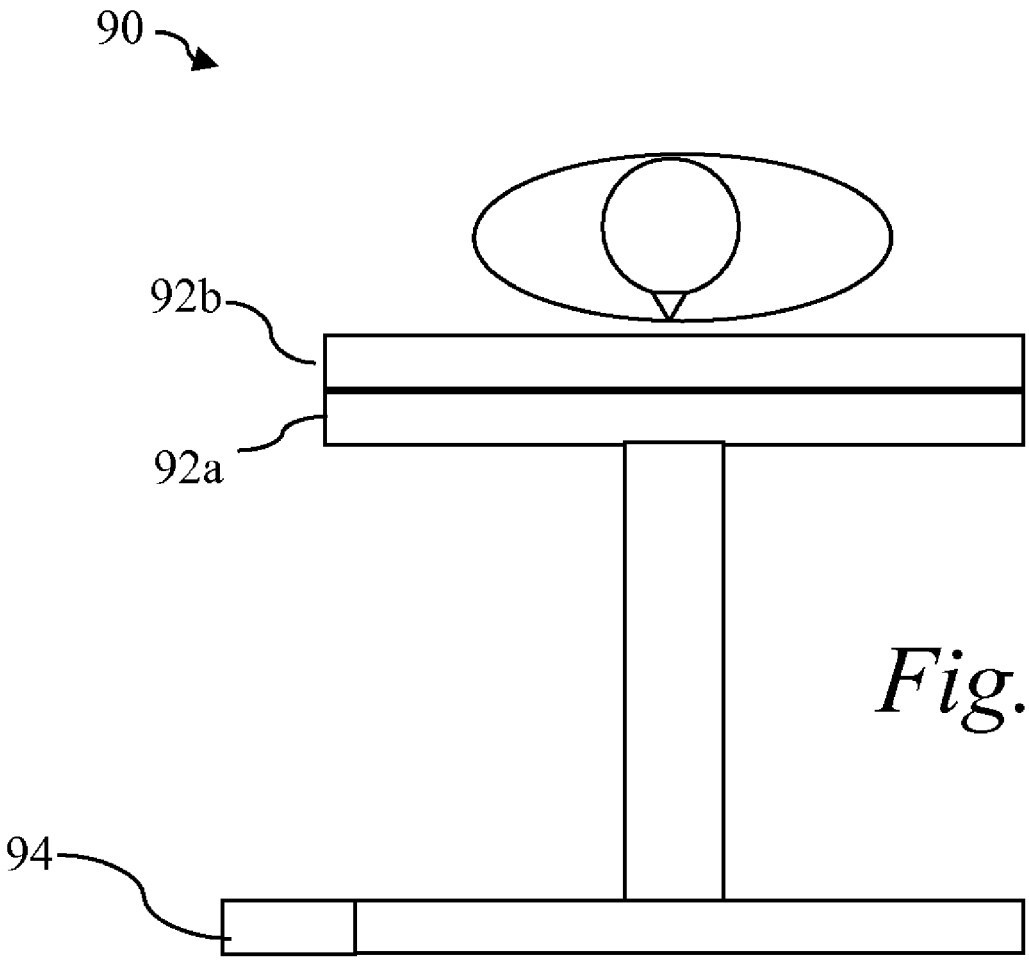

In FIG. 7*d*, the alternate bed platform 92*b* is rotated to a horizontal position. The primary bed platform 92 now aligns and interfaces with the alternate bed platform, as shown in FIG. 7*e*, with the patient now in prone position and the alternative bed platform 92*b* moved over the center of the base. The restraining straps may now be released and the patient positioned in the center of the alternate bed platform. As a final step, the "stabilization arm button" should now be engaged to a closed position and stabilizing arms from foot & head will retract into the table frame to their resting positions. The patient may now be redraped and the operative procedure continued.

Although the Detailed Description of the invention has been directed to certain exemplary embodiments, various modifications of these embodiments, as well as alternative embodiments, will be suggested to those skilled in the art. The invention encompasses any modifications or alternative embodiments that fall within the scope of the Claims.

What is claimed is:

1. An operating table comprising:

a first flat bed platform;

a second flat bed platform;

a first set of arms having respective ends that move up and down to change a vertical position of the first bed platform and to control an angle of the first bed platform;

a second set of arms having respective ends that move up and down to change a vertical position of the second bed platform and to control an angle of the second bed platform independently of the vertical position and angle of the first bed platform;

wherein the first and second arms move to change the vertical position and angle of the first and second bed platforms to aid in re-positioning a patient from a first position on one of the platforms to a second position on the other of the platforms and wherein said first and second sets of arms position the one platform under the other platform after re-positioning the patient.

2. The operating table of claim 1 wherein each of the first and second bed platforms can be rotated independently of the other.

3. The operating table of claim 1 wherein the arms are in first and second rows, where the first and second rows are independently controllable.

4. The operating table of claim 3 and further comprising:

at least one controllable arm for moving vertically and horizontally;

a carriage coupled to the arm for attaching to the bed platforms.

5. The operating table of claim 3 wherein the arms in the independently controllable first and second rows can extend and retract.

6. The operating table of claim 3 wherein the arms include rotating members for allowing the table to slide on the arms.

7. The operating table of claim 1, wherein the patient is maintained substantially in a center portion of the operating table during rotation.

8. The operating table of claim 3 and further comprising first and second controllable arms, each of which can be engaged with and disengaged from either of said first and second bed platforms.

9. The operating table of claim 8 and further comprising one or more straps for holding the patient to one of the bed platforms, where the straps are extendible while the patient is being held.

* * * * *